US006725571B2

(12) United States Patent
Liu

(10) Patent No.: US 6,725,571 B2
(45) Date of Patent: Apr. 27, 2004

(54) SHOE WITH OZONIZER

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 68 days.

(21) Appl. No.: 10/213,809

(22) Filed: Aug. 5, 2002

(65) Prior Publication Data

US 2004/0020076 A1 Feb. 5, 2004

(51) Int. Cl.[7] ..... A43B 7/00; C01B 13/11
(52) U.S. Cl. ..... 36/3 R; 36/3 B; 36/136
(58) Field of Search ..... 36/3 R, 3 B, 1, 36/132, 136

(56) References Cited

U.S. PATENT DOCUMENTS 2,442,026 A * 5/1948 Thompson, Jr. ..... 36/2.6
3,048,931 A * 8/1962 Farinello ..... 36/3 R
4,981,651 A * 1/1991 Horng ..... 422/24
5,367,788 A * 11/1994 Chen ..... 36/3 B
5,809,665 A * 9/1998 Suenaga ..... 36/43
5,921,003 A * 7/1999 Kim ..... 36/3 B
6,286,235 B1 * 9/2001 An ..... 36/132
6,594,917 B2 * 7/2003 Ricco' et al. ..... 36/3 R

FOREIGN PATENT DOCUMENTS

EP 1084639 * 3/2001

* cited by examiner

*Primary Examiner*—M. D. Patterson
(74) *Attorney, Agent, or Firm*—Knobbe, Martens, Olson & Bear, LLP

(57) ABSTRACT

A shoe includes a shoe body, an ozonizer, an ozone discharge pipe, and an air supply unit. The shoe body includes a sole unit connected to an upper and formed with a cavity for receiving the ozonizer. The ozone discharge pipe is connected to the ozonizer, and is in fluid communication with an interior space in the upper. The air supply unit is connected to the ozonizer to supply air for generating ozone and to subsequently force the ozone to flow from the cavity into the interior space via the ozone discharge pipe.

7 Claims, 5 Drawing Sheets

SHOE WITH OZONIZER

BACKGROUND OF THE INVENTION

1. Field of the Invention

The invention relates to a shoe, more particularly to a shoe with an ozonizer.

2. Description of the Related Art

One conventional way of disinfecting and deodorizing shoes is through the use of an ozone sterilizing device shown in FIG. 1. The ozone sterilizing device includes a main body 1 and a pair of insert seats 2. Each insert seat 2 is formed with a plurality of vent holes 201. Ozone generated within the main body 1 is discharged from the vent holes 201 in the insert seats 2.

In use, the shoes (not shown) are sleeved respectively on the insert seat 2 after removal from the wearer's feet. Through the ozone that comes out of the vent holes 201, the shoes are disinfected and deodorized.

However, use of the ozone sterilizing device can only reduce level of stench odor and amount of bacteria in the shoes, and cannot eradicate the stench odor and bacteria that already exist in the shoes. Furthermore, the ozone sterilizing device occupies a comparatively large space.

SUMMARY OF THE INVENTION

Therefore, the main object of the present invention is to provide a shoe with an ozonizer that is capable of overcoming the aforementioned drawbacks of the prior art.

According to the present invention, a shoe comprises a shoe body, an ozonizer, an ozone discharge pipe, and an air supply unit. The shoe body includes an upper having a top end, and a sole unit connected to the upper. The sole unit is formed with a cavity. The ozonizer is disposed in the cavity. The ozone discharge pipe is connected to the ozonizer, and is in fluid communication with an interior space in the upper. The air supply unit is connected to the ozonizer to supply air for generating ozone and to subsequently force the ozone to flow from the cavity into the interior space via the ozone discharge pipe.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
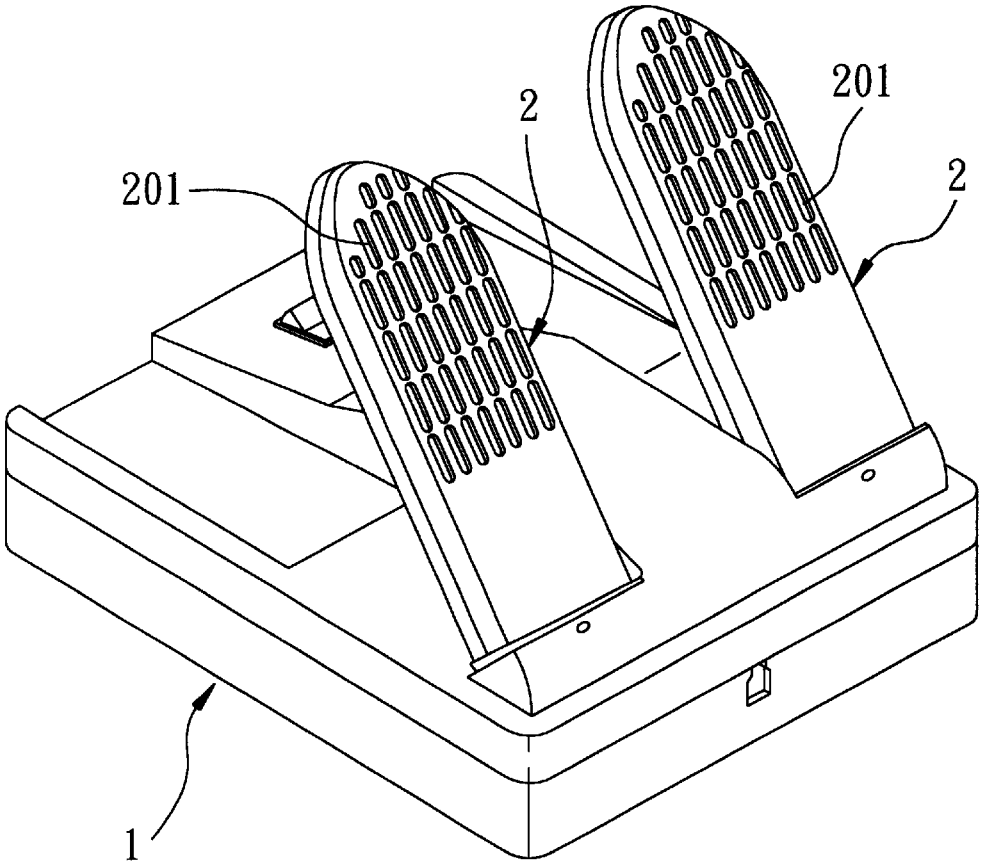
FIG. 1 PRIOR ART
FIG. 1 is a perspective view of a conventional ozone sterilizing device for disinfecting and deodorizing shoes.

Before the present invention is described in greater detail, it should be noted that like elements are denoted by the same reference numerals throughout the disclosure.

Figure 2:
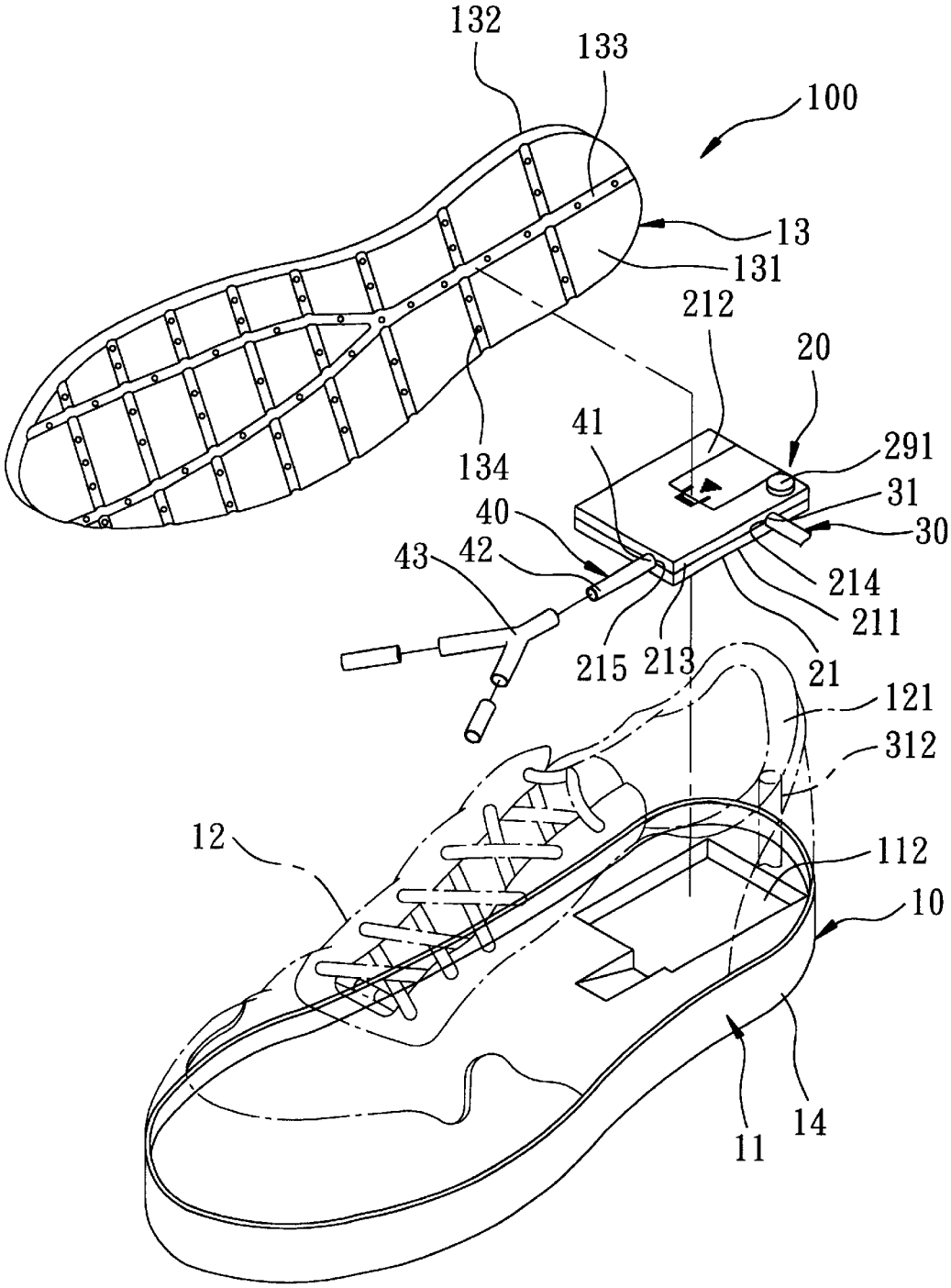
FIG. 2 is a partially exploded perspective view of the first preferred embodiment of a shoe according to the present invention.
Figure 3:
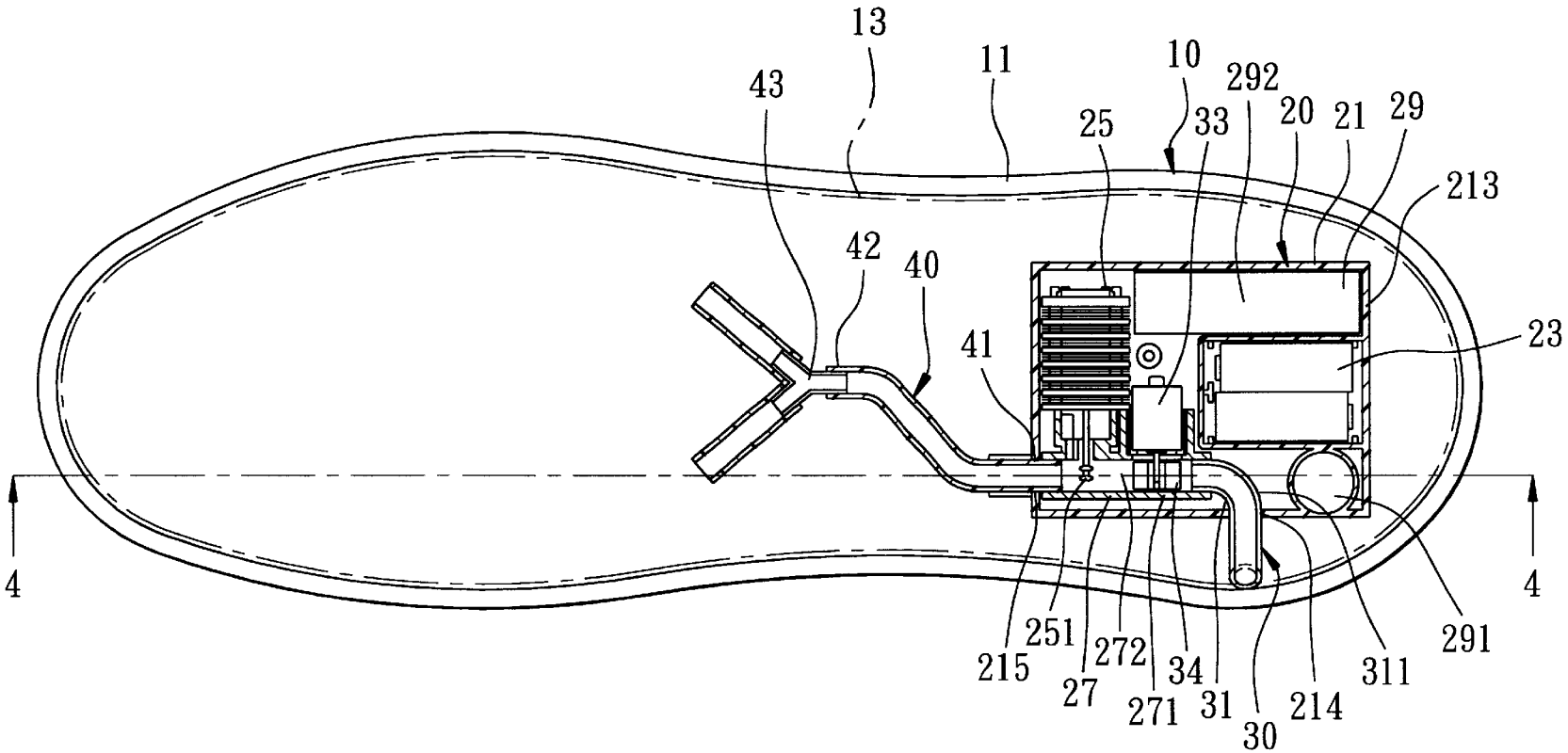
FIG. 3 is a partly sectional schematic view of the first preferred embodiment.
Figure 4:
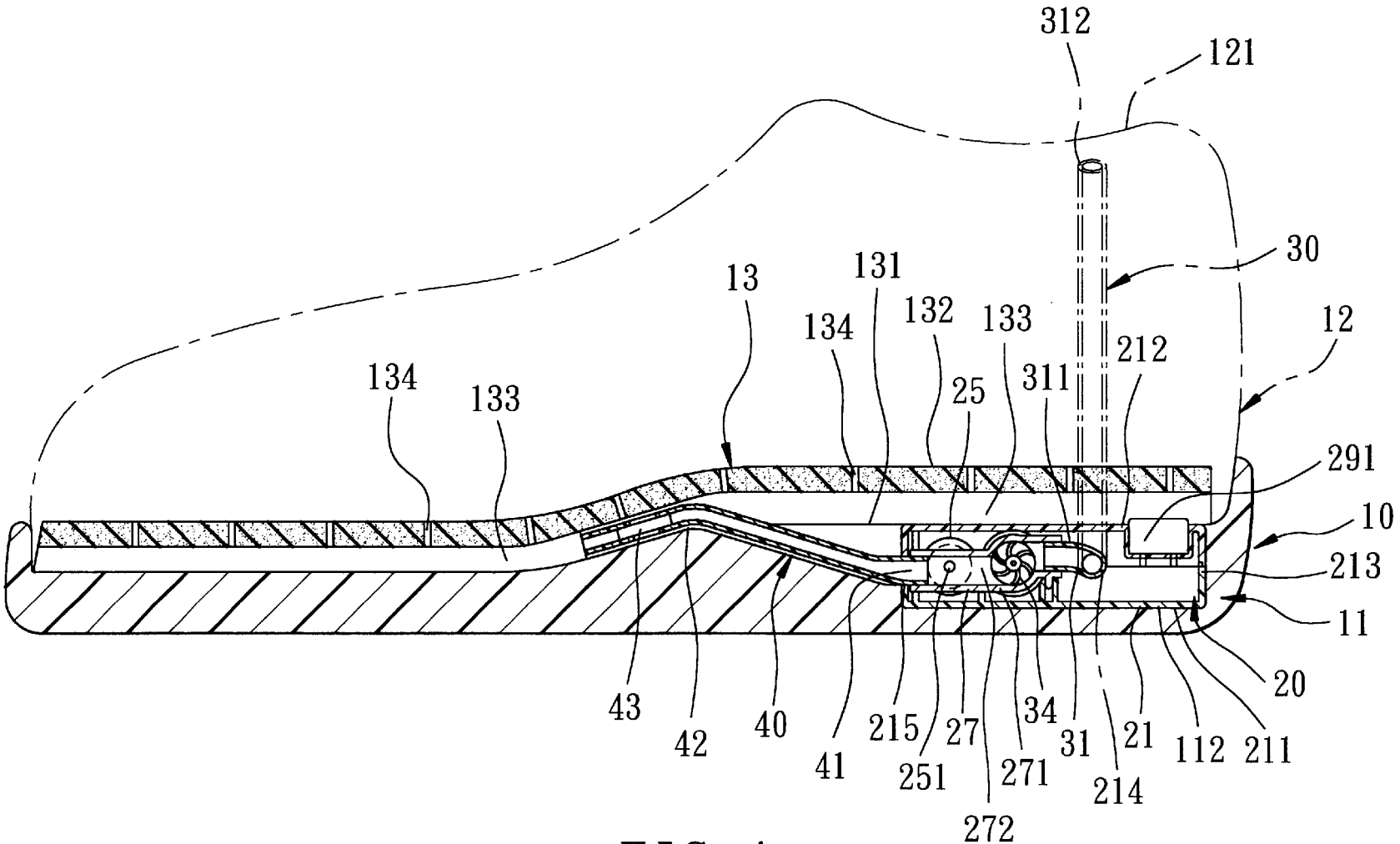
FIG. 4 is a sectional view taken along line 4—4 of FIG. 3.

Referring to FIGS. 2 to 4, the first preferred embodiment of a shoe 100 according to the present invention is shown to comprise a shoe body 10, anozonizer 20, an ozone discharge pipe 40, and an air supply unit 30.

The shoe body 10 includes an upper 12 having a top end 121, and a sole unit 11 connected to the upper 12. The sole unit 11 is formed with a cavity 112, and includes an outsole 14 and a midsole 13 disposed above the outsole 14. The outsole 14 has a heel region, within which the cavity 112 is formed. The midsole 13 has a bottom surface 131 formed with a plurality of intersecting air channels 133, and a plurality of vertical vent holes 134 that extend from the bottom surface 131 to a top surface 132 of the midsole 13 and that are in fluid communication with the air channels 133.

The ozonizer 20 has a housing 21 disposed in the cavity 112, and includes a metal tube 27, an anion generator 25, a battery unit 23, and a control device 29. The housing 21 has an upper wall 212 and a lower wall 211 opposite to the upper wall 212, and a peripheral wall 213 that extends between the upper and lower walls 212, 211. The peripheral wall 213 is formed with spaced-apart inlet and outlet holes 214, 215. The metal tube 27 is disposed between the inlet and outlet holes 214, 215, and has a tubular wall 271 defining a passage 272. The anion generator 25 has a discharging end 251 extending into the passage 272. The battery unit 23 is connected to the anion generator 25. The control device 29 is operable so as to activate the anion generator 25 and the air supply unit 30 in order to generate ozone within the passage 272. The control device 29 includes a switch 291 and a circuit board 292. The circuit board 292 is connected electrically to the switch 291 and the discharging end 251 of the anion generator 25 so that the discharging end 251 can discharge a high voltage current.

The air supply unit 30 is connected to the ozonizer 20 to supply air into the metal tube 27 for the production of ozone. The air supply unit 30 includes an air pump and an inlet tube 31. The air pump includes a motor 33 connected electrically to the battery unit 23 of the ozonizer 20, and a propeller 34 connected to an output shaft of the motor 33 and positioned within the passage 272 in the metal tube 27 of the ozonizer 20. The inlet tube 31 has an inner end 311 and an outer end 312. The inner end 311 extends through the inlet hole 214 and into the cavity 112, and is press-fitted into a rear end of the metal tube 27. The outer end 312 extends toward the top end 121 of the upper 12 of the shoe body 10, and is in fluid communication with an exterior side of the shoe body 10 via voids (not shown) in the top end 121 of the upper 12.

The air pump, the metal tube 27, the anion generator 25, the battery unit 23, and the circuit board 292 are disposed inside the housing 21 of the ozonizer 20, as best illustrated in FIG. 3. The switch 291 controls actuation of the motor 33 and the anion generator 25, and is mounted on a top surface of the upper wall 212 of the housing 21 at a location that permits the switch 291 to be actuated by a wearer's foot (see FIGS. 2 and 3) when the shoe 100 is worn on the foot.

The ozone discharge pipe 40 is connected to the ozonizer 20, and has a positioning end 41 and an ozone release end 42. The positioning end 41 extends into the metal tube 27 via the outlet hole 215, and is press-fitted into a front end of the metal tube 27 so as to be in fluid communication with the metal tube 27. The ozone release end 42 extends into and is in fluid communication with the air channels 133, and is sleeved on a rear end of a 3-way tubular element 43 so that ozone current can be distributed uniformly throughout the interior space in the shoe body 10.

In use, when the wearer's foot is slipped into the interior space in the shoe body 10, the switch 291 can be actuated. The motor 33 and the anion generator 25 are activated consequently. The propeller 34 sucks air via the outer end 312 of the inlet tube 31 into the metal tube 27. The discharging end 251 of the anion generator discharges a high voltage current into the tubular wall 271 of the metal tube 27 so as to generate anions. The anions cause the air that flows through the passage 272 in the metal tube 27 to produce ozone. The ozone current is then discharged into the air channels 133 in the midsole 13 via the release end 42 of the ozone discharge pipe 40, and is distributed throughout the interior space in the upper 12 of the shoe body 10 via the vertical vent holes 134 in the midsole 13. Thus, the shoe 100 of the present invention can provide effectively disinfection and deodorization to the wearer's foot due to the ozone current. That is, when the wearer's foot excretes perspiration while wearing the shoe 100, the ozone current dissipates moisture inside the shoe body 10, thereby reducing temperature and humidity inside the latter, and thereby preventing occurrence of the stench odor and minimizing growth of the bacteria inside the shoe body 10. As such, when the shoe 100 is taken off, the shoe body 10 does not have stench odor and only has comparatively small amount of bacteria.

Therefore, disinfection and deodorization occur when the shoe 100 of the present invention is worn such that sanitation of the wearer's foot is assured. Moreover, the ozonizer 20, the ozone discharge pipe 40, and the air supply unit 30 are directly mounted on the shoe body 10 such that the shoe 100 of the present invention is very convenient to use.

Figure 5:
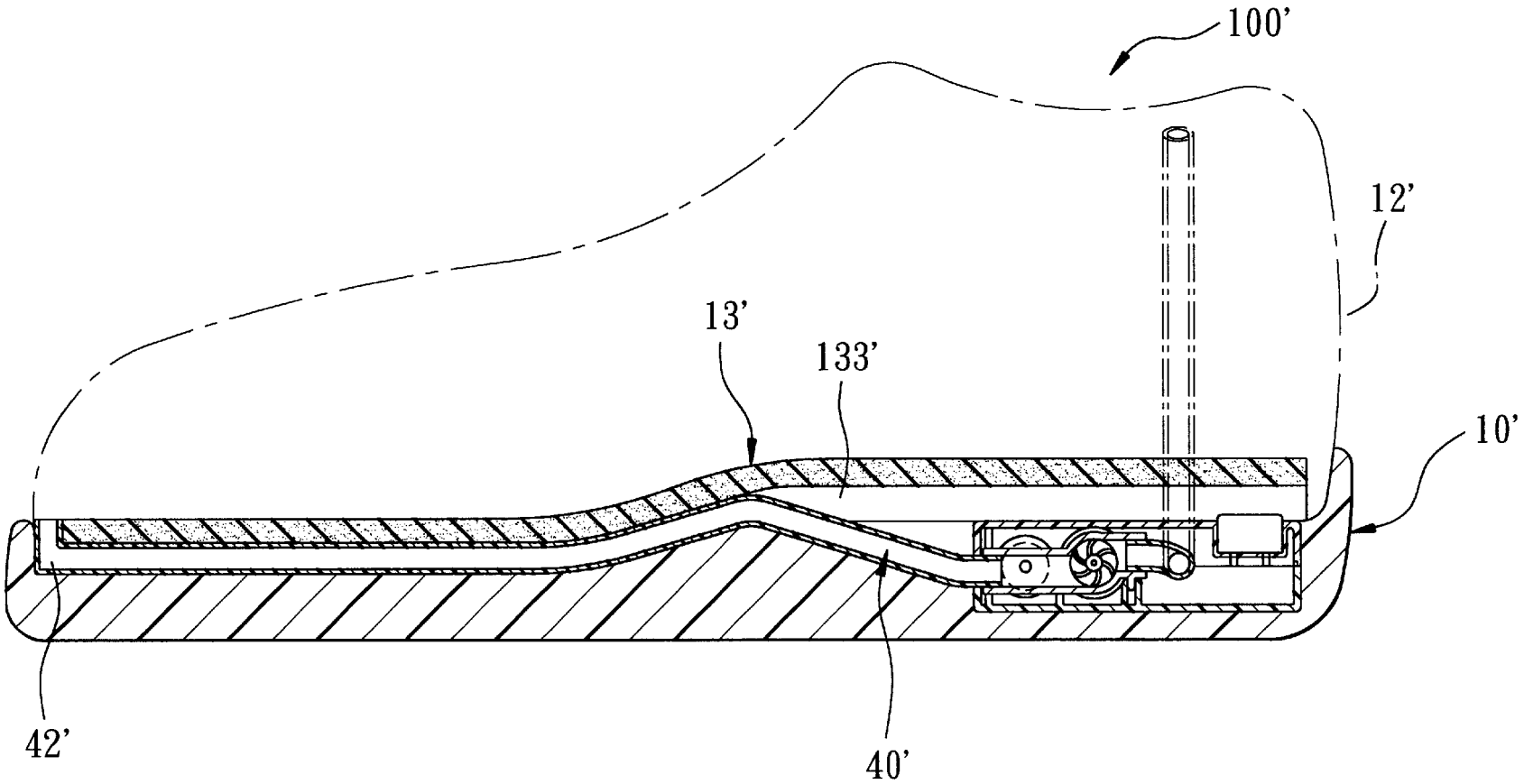
FIG. 5 is a fragmentary sectional view of the second preferred embodiment of a shoe according to the present invention.

Referring to FIG. 5, the second preferred embodiment of a shoe 100' according to the present invention is shown to be generally similar to the first preferred embodiment. Unlike the first preferred embodiment, the midsole 13' has no vertical vent holes, and the ozone discharge pipe 40' extends forward to a front end of the shoe body 10' and has an outlet end 42' that is in fluid communication with the interior space in the upper 12' of the shoe body 10'.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoe comprising:

a shoe body including an upper and a sole unit connected to said upper, said upper having a top end and an interior space, said sole unit being formed with a cavity;

an ozonizer disposed in said cavity;

an ozone discharge pipe connected to said ozonizer and in fluid communication with said interior space in said upper; and an air supply unit connected to said ozonizer to supply air for generating ozone and subsequently forcing the ozone to flow from said cavity into said interior space via said ozone discharge pipe.

2. The shoe as claimed in claim 1, wherein said ozonizer includes a metal tube connected to said air supply unit and in fluid communication with said ozone discharge pipe, an anion generator having a discharging end extending into said metal tube, a battery unit connected to said anion generator, and a control device operable so as to activate said anion generator and said air supply unit for generating ozone within said metal tube and subsequently forcing the ozone to flow from said metal tube into said interior space via said ozone discharge pipe.

3. The shoe as claimed in claim 2, wherein said air supply unit includes an air pump including a motor connected electrically to said battery unit, and a propeller connected to said motor and positioned within said metal tube of said ozonizer so that said propeller can be rotated by said motor, thereby forcing the ozone to flow from said metal tube into said ozone discharge pipe, and an inlet tube having an inner end extending into said cavity and press-fitted within said metal tube, and an outer end extending toward said top end of said upper of said shoe body and in fluid communication with an exterior side of said shoe body.

4. The shoe as claimed in claim 3, wherein said control device includes a switch for controlling actuation of said motor and said anion generator, and a circuit board connected electrically to said switch and said discharging end so that said discharging end can discharge a high voltage current.

5. The shoe as claimed in claim 4, wherein said ozonizer further includes a housing to receive said air pump, said metal tube, said anion generator, said battery unit, and said circuit board, said housing having an inlet hole for passage of said inner end of said inlet tube, and an outlet hole for passage of said ozone discharge pipe, said switch being mounted on said housing at a location that permits said switch to be actuated by a wearer's foot when said shoe is worn on the foot.

6. The shoe as claimed in claim 2, wherein said sole unit includes an outsole and a midsole disposed above said outsole, said outsole having a heel region, within which said cavity is formed.

7. The shoe as claimed in claim 6, wherein said midsole has a bottom surface formed with a plurality of intersecting air channels that are in fluid communication with said ozone discharge pipe, and a plurality of vertical vent holes that are formed through said midsole and that are in fluid communication with said air channels.

* * * * *